US007748317B2

(12) United States Patent
Puig Vila et al.

(10) Patent No.: US 7,748,317 B2
(45) Date of Patent: Jul. 6, 2010

(54) AUTOMATIC HANDLING AND TRANSPORTATION DEVICE FOR A PRINTER HOUSING

(75) Inventors: Jordi Puig Vila, Riudellots de la Selva (ES); Jordi Sahun Peres, Riudellots de la Selva (ES); Pere Roger I Colom, Riudellots de la Selva (ES); Lluis Esparch Marti, Riudellots de la Selva (ES)

(73) Assignee: Comexi, SA, Riudellots de la Selva (Girona) (ES)

( * ) Notice: Subject to any disclaimer, the term of this patent is extended or adjusted under 35 U.S.C. 154(b) by 706 days.

(21) Appl. No.: 10/586,465

(22) PCT Filed: Dec. 29, 2004

(86) PCT No.: PCT/ES2004/000585

§ 371 (c)(1), (2), (4) Date: May 30, 2007

(87) PCT Pub. No.: WO2005/068201

PCT Pub. Date: Jul. 28, 2005

(65) Prior Publication Data

US 2007/0214978 A1 Sep. 20, 2007

(30) Foreign Application Priority Data

Jan. 14, 2004 (ES) ..... 200400066

(51) Int. Cl.
*B41F 5/00* (2006.01)

(52) U.S. Cl. ..... 101/216; 101/375; 101/383; 101/388; 101/408; 101/479; 101/410; 101/477

(58) Field of Classification Search ..... 101/477, 101/218, 219, 378, 479, 216, 388, 383, 408, 101/410, 375

See application file for complete search history.

(56) References Cited

U.S. PATENT DOCUMENTS 4,119,032 A 10/1978 Hollis (Continued)

FOREIGN PATENT DOCUMENTS

EP 0 955 161 A2 11/1999

(Continued)

OTHER PUBLICATIONS

International Search Report for PCT International Application No. PCT/ES 2004/000585 mailed Apr. 21, 2005.

*Primary Examiner*—Judy Nguyen
*Assistant Examiner*—Matthew G Marini
(74) *Attorney, Agent, or Firm*—RatnerPrestia

(57) ABSTRACT

The invention relates to an automatic handling and transportation device for a printer housing. The device comprises a basic mobile unit movable on a first route and at least one handling unit mounted on the basic mobile unit. The handling unit includes a support for guiding and supporting housings born on a second route parallel to a housing-bearing assembly on a printing machine, able to be aligned with the same and an grasping/holding device, adapted to hold a housing and move it on the second route between a transferral position in which the grasping/holding device interacts with the housing installed on the housing-bearing assembly, and a transportation position in which the housing, held by the grasping/holding device is on the support, and vice-versa.

30 Claims, 6 Drawing Sheets

U.S. PATENT DOCUMENTS

| | | | | | |
|---|---|---|---|---|---|
| 4,386,566 | A | | 6/1983 | Moss | |
| 4,413,560 | A | * | 11/1983 | Rogge | 101/247 |
| 4,520,728 | A | * | 6/1985 | Ecker et al. | 101/248 |
| 5,275,105 | A | * | 1/1994 | Schweizer et al. | 101/477 |
| 5,370,047 | A | * | 12/1994 | Compton | 101/216 |
| 5,549,044 | A | | 8/1996 | Achelpohl | |
| 5,638,754 | A | * | 6/1997 | Steinmeier et al. | 101/477 |
| 6,085,650 | A | * | 7/2000 | Petersen | 101/220 |
| 6,314,882 | B1 | * | 11/2001 | Petersen | 101/219 |
| 6,644,188 | B2 | | 11/2003 | Kolbe et al. | |
| 2004/0045468 | A1 | * | 3/2004 | Goldhurt et al. | 101/479 |

FOREIGN PATENT DOCUMENTS

| | | |
|---|---|---|
| ES | 459365 | 3/1978 |
| ES | 2115136 T | 6/1998 |
| WO | WO 03/095207 A1 | 11/2003 |

* cited by examiner

AUTOMATIC HANDLING AND TRANSPORTATION DEVICE FOR A PRINTER HOUSING

This application is a U.S. National Phase Application of PCT International Application No. PCT/ES2004/000585 filed Dec. 29, 2004.

TECHNICAL FIELD

This invention relates to an automatic handling and transportation device for a printer housing suitable for use in flexographic printer cylinder changing operations whilst the printer is operating.

BACKGROUND OF THE INVENTION

Printing machines are well-known, especially flexographic printing machines which are fitted with a large, central support drum which rotates on a horizontal axis and along which moves a strip of material to be printed and a number of printing clusters are on each side of said support drum. Each printing cluster is designed to print, for example, one colour only for which it comprises a printing cylinder bearing a block with the design to be printed and one or more ink-rollers connected to their respective containers of ink of the corresponding colour positioned to ink the corresponding printing cylinder block. Both the inking rollers and the printing cylinder are positioned to turn on axes parallel to the axis of the support drum with means provided for moving the printing cylinder laterally into contact with the support drum and the inking rollers into contact with the printing cylinder or for separating them.

Each block is mounted on a housing which in turn is mounted on a housing-bearing assembly supported at each extremity by existing supports on opposite sides of the printing machine and operated in turn from one of said extremities. The latest developments in flexographic printing machines incorporate means for maintaining the respective housing-bearing assembly projecting outwards by one of its extremities to allow the withdrawal of the corresponding block-bearing housing by the opposing extremity by sliding it axially along the assembly and the positioning of a new housing by reversing the procedure when a printing cylinder is separated from the support drum. Although technically such housing-changing operations can be undertaken with the printer in operation they are extremely dangerous for the operator due to the proximity of the moving support drum. Furthermore, the block-bearing housings can be both large in size and in weight requiring the assistance of a number of workers or the use of lifting devices such as cranes, pulleys etc. adding to the degree of risk with the machine in operation. As a result, in practice, housing-changing operations are undertaken with the machine at rest which brings with it a significant loss of productivity.

U.S. Pat. No. 6,644,188 describes a procedure for changing housings with the printing machine of the type described above operating. The method foresees the installation of a protective screen between an extremity of the printing cylinder and the support drum so as to provide an area of protection sufficient to allow the operator to take hold of said extremity of the cylinder with relative safety whilst the machine is in operation. However, such screens do not provide total protection and, taking into account that there are flexographic printers with ten or more print clusters and that a protective screen is required for each one, the means for mounting and dismounting such screens is of great complexity in relation to the low level of protection offered. Furthermore, even with the use of said protective screens, the inconveniences associated with the difficulty of handling the housings due to their large size and weight, persist.

On the other hand, document WO 03/095207, of which the present petitioner is owner, describes a housing-extraction device comprising an instrument in the shape of a glass adapted to fit the frontal extremity of the housing into its open end locating part of the extremity of the housing-bearing assembly inside said glass form and a means of injecting compressed air using various alternative methods, adapted so as to create air pressure in the interior of the glass-shaped instrument able to make the housing slide axially along the length of the housing-bearing assembly in order to extract it. A further version is known of where the piston of a pneumatic cylinder attached to the instrument in the form of a glass is what thrusts the assembly to move along the housing. However, these devices are only to initiate the sliding motion of the housing which, in general, is difficult to effect manually due to the resistance created by the close fit of the housing on the assembly and the subsequent extraction of the housing which must be done by hand for which purpose one or more handles are foreseen on the glass-shaped instrument.

There is a need for an automatic housing handling and transportation device which permits housing changing operations to be carried out on a printer with the machine in operation which is totally automatic and without the need for operator intervention and automatic movement and storage of housing operations.

BRIEF DESCRIPTION OF THE INVENTION

The present invention seeks to satisfy the above need by providing an automatic printer housing handling and transportation device comprising a support to guide and support housings capable of being positioned in alignment with and close to a housing-bearing assembly and an instrument for attachment which can be moved from a transfer position in which the grasping/holding device interacts with said housing mounted on the housing-bearing assembly to grasp or to free it and a transportation position in which the housing grasped by the grasping/holding device is on the support. The support may have distinct configurations such as, for example, a mandril or cradle and the grasping/holding device activated in order to hold the housing by one extremity. So, when the grasping/holding device is displaced, it drags the housing along transferring it from the said housing-bearing assembly which, for example, may be installed in a jutting position on a printing machine, to the support for the device. An operation in the reverse direction transfers the housing from the support for the device to the machine's housing-bearing assembly and frees it in the same operation.

According to an embodiment, the device comprises a basic mobile unit and means of displacement arranged to move said basic mobile unit on a first route. Mounted on said basic mobile unit are one or more handles. Each handle includes one of the above-mentioned supports which juts out on a second route, transverse to the previous route and parallel to the said housing-bearing assembly. The grasping/holding device is connected to a second means of displacement arranged to displace it in the other direction in relation to the support.

Preferably, the basic mobile unit is displaced by means of a guide such as, for example, ways arranged horizontally on the first route along a stretch including a first transfer area in which the handling unit mounted on the basic mobile unit is activated to interact with said printing machine and at least one second transfer area in which the basic mobile unit in which the handling unit mounted on the basic mobile unit is activated to interact with the transportation unit or with said storage place. Generally, it is foreseen that the handling unit mounted on the basic mobile unit changes over the housings from the printing machine and the transportation unit either by means of a motorised saddle or a self-propelled saddle and that this transportation unit will be responsible for moving the housings between said second transfer area and various other places amongst which may be said storage place and a maintenance area where blocks may be changed, cleaning carried out etc. However, the installation may be arranged in such a way that the handling unit mounted on the basic mobile unit exchanges the housings between the printing machine and the storage place or between the printing machine, the storage place and the transportation unit or other combinations.

According to a first embodiment, on the basic mobile unit there is mounted a single handling unit and a third means of displacement is provided, arranged to move the handling unit in relation to the basic mobile unit on a third route, vertical or transverse to either the first or the second route. In general, the first, second and third routes correspond respectively to the three orthogonal axes X, Y, Z of a system of Cartesian coordinates where the axes X, Y are horizontal and axis Z is vertical. By combined activation of the first and third means of displacement the single support mounted on the handling unit mounted in turn on the basic mobile unit may be positioned in alignment with any housing-bearing assembly on the printing machine or with any support in the storage place or the transportation unit and, by operating the second displacement means a housing may be transferred from the chosen housing-bearing assembly on the printing machine or support in the storage place or the transportation unit to the support on the transportation unit or the support on the handling unit or vice-versa.

According to a second embodiment, on the basic mobile unit are mounted various handling units in fixed positions in which the respective supports are at a height coinciding with the height of various housing-bearing assemblies on the printing machine or supports on the transportation unit or in the storage place. With this, the third means of displacement on the vertical route is unnecessary and is not included. According to a variant of this second embodiment the said various housing-bearing assemblies of the printing machine comprise all the housing-bearing assemblies on one side of the support drum of the printing machine. That is to say that if we take as an example a printing machine with ten symmetrically distributed printing assemblies, five on each side vertically arranged through the axis of rotation of the central support drum, in the basic mobile unit will be mounted five handling units in positions such that the respective supports are at the same heights as the corresponding housing-bearing assemblies on each side of the printing machine. However, the fixed positions of the various handling units on the basic mobile unit are aligned vertically whilst the housing-bearing assemblies of the printing machine are arranged following the outline of the support drum and as a result are not vertically aligned. As a result, the handling units mounted on the basic mobile support are useful for changing the housings from one side to the other of the printing machine although each handling unit should be individually lined-up with its corresponding housing-bearing assembly of the printing machine by means of the assembling of the first means of displacement. In this way, the various housings on one side of the printing machine are transferred sequentially, one after the other, but with minimal displacements of the basic mobile unit carrying-out at the same time, the transfers of the housings between said first and second transfer areas.

According to another variant of the second embodiment, the fixed positions of the various handling units on the basic mobile unit are such that the respective supports may be aligned at once with various housing-bearing assemblies on the printing machine or supports on the transportation unit or the storage place. In this way for example a basic mobile unit may be built on which may be mounted the same number of handling units as printing clusters are arranged around the support drum of the printing machine and in fixed positions such that all the supports on the handling units may be aligned at once with the corresponding housing-bearing assemblies on both sides of the printing machine support drum by a single activation of the first means of displacement. That is to say that in a printing machine such as that described in the previous example with ten printing assemblies, the ten housings may be transferred at once and transported with a single activation of the first means of displacement. A device may also be made with two basic mobile units which will move in opposite directions on the same ways or on different ways and each basic unit will carry as many handling units in fixed, concordant positions as printing assemblies distributed along the corresponding side of the printing machine's support drum with each basic mobile unit responsible for half of the printer's printing clusters. Clearly, with these two last arrangements, the supports on the transportation unit and/or the storage place have to be set out in identical positions relative to the housing-bearing assemblies of the printing machine if it is desired that transfer of all the housings from the handling units to the transportation unit or the storage area, or vice-versa, be carried out in one operation.

Any of the embodiment examples described can be controlled remotely using electronic means which may be programmable by which the automatic housing handling and transport device of this invention permits completely automatic changes of housing operations to be carried out on a printing machine whilst it is in operation without the intervention of the operator. With this, on one hand, the implied risk to the operator of changing housings whilst the machine is in operation is eliminated and, on the other, carrying out a change of housing whether or not the machine is in operation, significantly more quickly than manually even when aided by means for its drawing and lifting. In addition, the device also permits the carrying out of automatic operations of movement and storage of housings whether or not associated with operations to change housings on the printing machine.

BRIEF DESCRIPTION OF THE DRAWINGS

The previous and other advantages and characteristics of the device of the present invention will be better understood from the following detailed description of embodiment examples with reference to the attached drawings in which.

DETAILED DESCRIPTION OF SOME EMBODIMENT EXAMPLES

Figure 1:
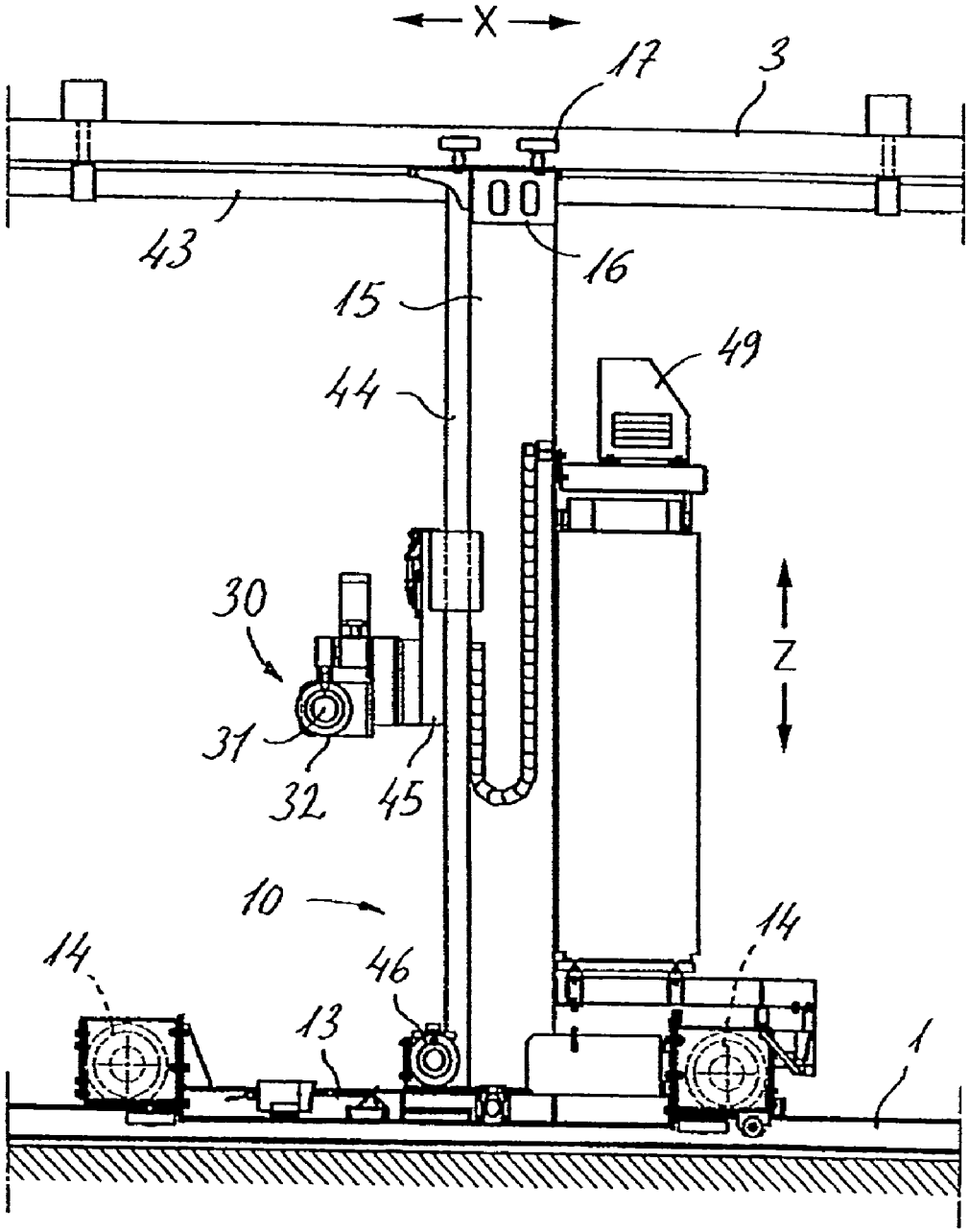
FIG. 1 is a frontal elevation view of a mobile unit according to a first embodiment of the automatic handling and transportation device for a printer housing of the present invention.
Figure 2:
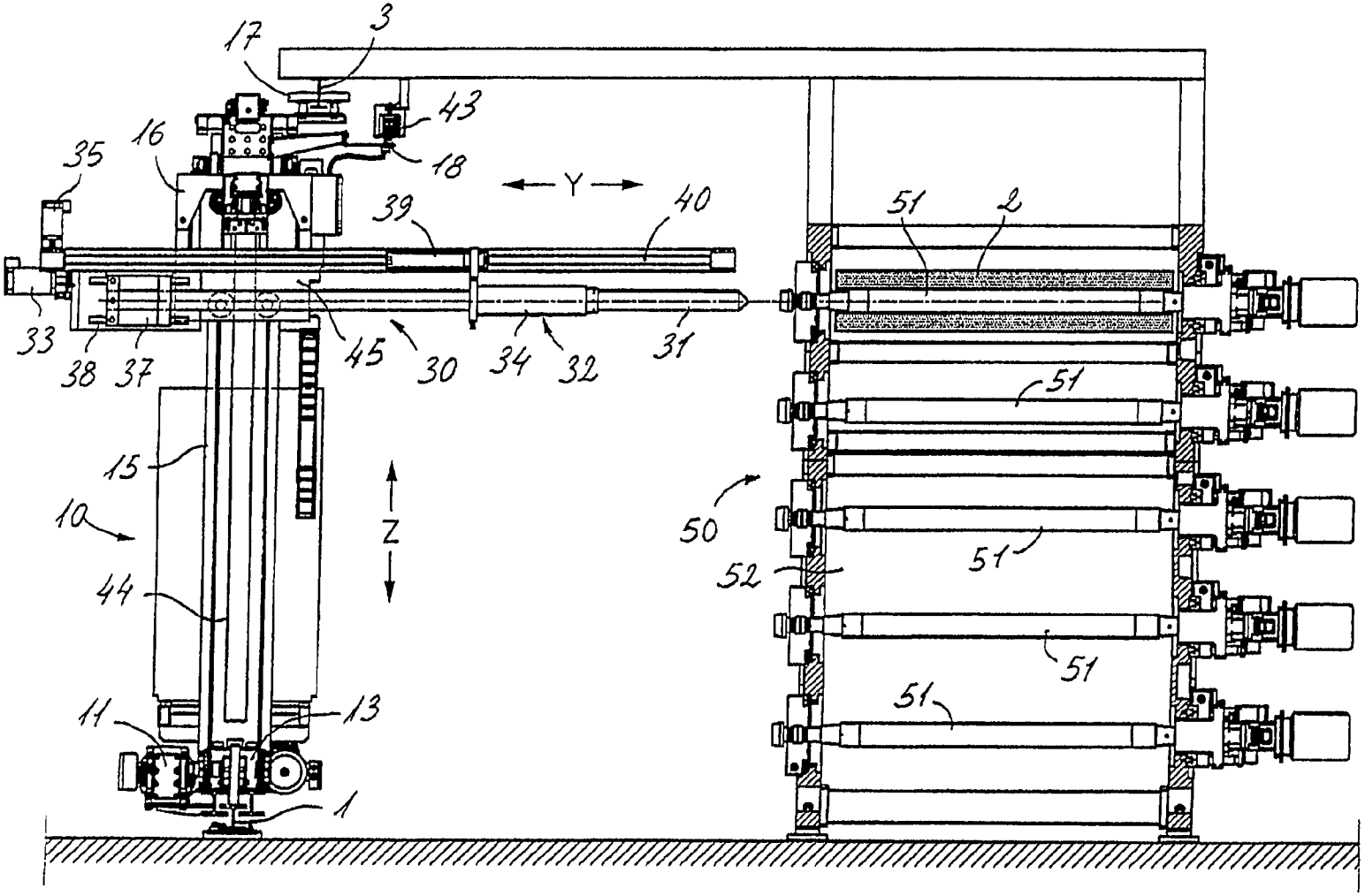
FIG. 2 is a side elevation view of the mobile unit in FIG. 1 against a printing machine.

Reference is first made to FIGS. 1 and 2, in which are shown an automatic handling and transportation device for a printer housing according to a first embodiment of the present invention. The device comprises a basic mobile unit 10 and a handling unit 30 mounted on said basic mobile unit 10. Said basic mobile unit 10 comprises a lower section 13 provided with the first means of displacement which comprise wheels 14 adapted for displacement along lower way 1 which runs on first route X, at least one of the wheels 14 being a tractor wheel operated by motor 11. On this lower section 13 there is a raised section 15 on which the handling unit 30 is supported. At an upper extremity of said raised section 15, the basic mobile unit 10 comprises also an upper section 16 provided with wheels 17 arranged to run along the upper way 3 which also runs on said first route X, that is to say, parallel with lower way 1. The upper way 3 has, associated with it, running along its length, an electric current conduit track 43 and control signals and said upper section 16 of the basic mobile unit 10 includes a dynamic power socket 18 to take said electricity supply and control signals from said track 43. The control signals remotely control the operation of the device and are emitted by electronic means of remote processing, preferably programmable.

Figure 3:
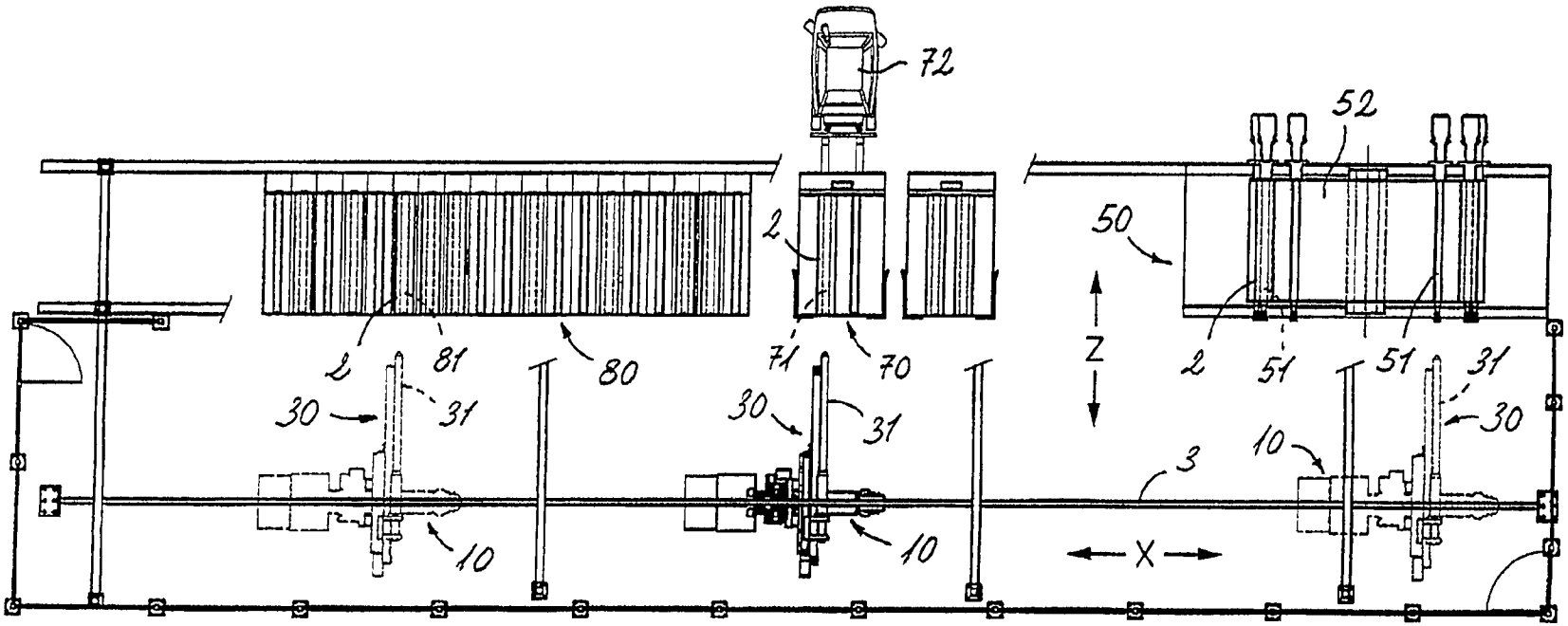
FIG. 3 is a plan view of an installation including the device of the present invention.

The handling unit 30 mounted on said basic mobile unit 10 is provided with a support 31, for guiding and supporting the housings which is arranged on a second route Y, transversal to said first route X and parallel to at least one housing-bearing assembly 51 installed in a jutting position on a printing machine 50 (see FIG. 2) or support 71, 81 installed on a transportation unit 70, or in a storage place 80 (see also FIG. 3). Said supports 31, 71, 81 have, in the illustrated embodiment examples, the form of a mandril held in a jutting position with an extremity capable of being situated in alignment with said housing-bearing assembly 51 and capable of taking a housing inserted through the axial bore of the same, although this may equally well take the form of a cradle, with one extremity able to be placed in alignment with said housing bearing assembly 51 and to receive a housing supported by means of the cylindrical, external surface of the same.

Associated with the support 31 of the handling unit 30 there is an grasping/holding device 32 arranged to grasp a housing 2 and a second means of displacement 35, 39, 40 adapted to displace the grasping/holding device 32 on said second route Y between a transferral position in which the grasping/holding device 32 interacts with said housing 2 installed on the housing-bearing assembly 51 (or support 71, 81 of the transportation unit 70 or storage place 80), and a transportation position in which the housing 2, being grasped by the grasping/holding device 32, is on the support 31. Said second means of displacement comprises guide means 40 on the second route Y, placed adjacent to the support 31 and at a distance from the same and a saddle 39 placed to move along the ways 40 being operated by a motor 35. The grasping/holding device 32 is fixed to the saddle 39 and moves with it.

Figure 4:
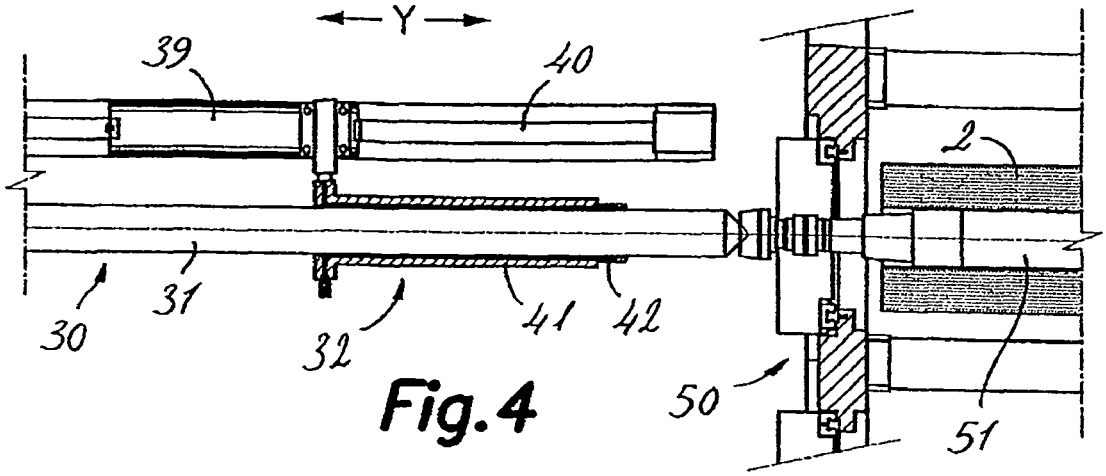
FIGS. 4 to 6 are detail cross-section views which show a representative sequence of the interaction between the handling unit mounted on the basic mobile unit and a print cluster on the printing machine.
Figure 5:
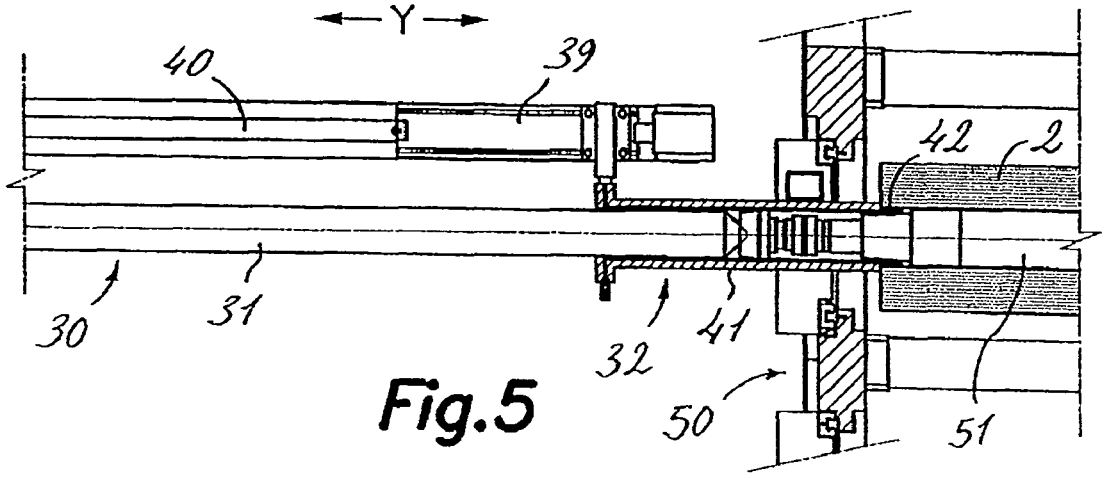
Figure 6:
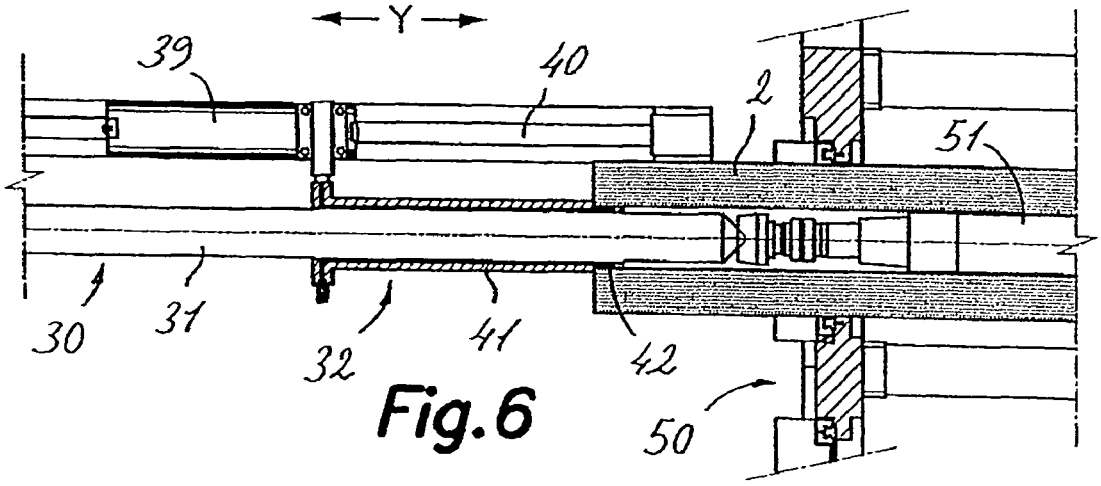

Although it is not indispensable, the device preferably comprises means of movement 33, 37, 38 adapted to move said support 31 on said second route Y in order to bring its free extremity close to the corresponding free extremity of the housing-bearing assembly 51 (or support 71, 81 of the transportation unit 70 or place of storage 80). When the support 31 takes the form of a mandril, the free extremity of the same takes a convex, conical shape fitting into the concave, conical shape formed in the free extremity of the housing-bearing assembly 51, or of the support 71, 81 of the transportation unit 70, or place of storage 80 when this also takes the form of a jutting mandril. Thus, when the support 31 is aligned with the housing-bearing assembly 51, the means of movement 33, 37, 38 displace the support 31 to fit the tapered end into the tapered bore of the housing-bearing assembly 51, which helps to centre both as shown in FIGS. 4 to 6.

These means of movement 33, 37, 38 comprise guide-ways 38 in the second direction Y, with which is associated a saddle 37 to which is fixed an extremity of the support 31 and a motor 33 connected and adapted to move said saddle 37 along said guide-ways 38. In the example illustrated, said guide-ways 40 of the saddle 39 carrying the grasping/holding device 32 are fixed to said saddle 37 carrying the support 31, and move with it.

In the embodiment shown in FIGS. 1 and 2, the only handling unit 30 is mounted on the basic mobile unit 10 by means of a third means of displacement 44, 45, 46 arranged to move the handling unit 30 in relation to the basic mobile unit 10 on a third route Z, vertically and transversally to the first and second routes X, Y. These third means of displacement comprise guide-ways 44, arranged in said third route Z along said elevated section 15 of the basic mobile unit 10 and a saddle 45, on which is mounted the handling unit 30, arranged to run along said guide-ways 44 by a motor 46 connected and arranged for that purpose. With this arrangement, the support 31 of this single handling unit 30 can be positioned in alignment with any housing-bearing assembly 51 of the printing machine 50, or with any support 71, 81 on the transportation unit 70 or the place of storage 80, by a combined activation of said first and third means of displacement on routes X, Z, and by activating the second means of displacement on route Y, a housing can be transferred from the chosen housing-bearing assembly 51 on the printing machine 50, or support 71, 81 of the transportation unit 70 or from the place of storage 80, to the support 31 of the handling unit 30, or vice-versa.

Alternatively or additionally, the handling unit 30 can be mounted on the basic mobile unit 10 by means of a means of rotation (not shown) arranged to rotate the handling unit 30 in relation to the basic mobile unit 10 around an axis parallel to the third route Z at a certain angle to the second route Y, such as, for example, 90° or 180°. This possibility of rotation gives the device greater versatility.

According to a second embodiment described below in detail in relation to FIGS. 8 and 9, on the basic mobile unit 10 are mounted various handling units 30 in fixed positions disposing with the need for the third means of displacement 44, 45, 46 on the third route Z.

In FIG. 3 an installation equipped with a device in accordance with this invention is shown where said ways 1, 3, by means of which the basic mobile unit 10, are extended on said first horizontal route X, along a stretch which includes the first transferral area in which the handling unit 30 mounted on the basic mobile unit 10 operates in interaction with a printing machine 50 fitted with several printing clusters around a central support drum 52, a second transferral area in which the handling unit 30 mounted on the basic mobile unit 10 operates in interaction with a transportation unit 70, and a third transferral area where the handling unit 30 mounted on the basic mobile unit 10 operates in interaction with a place of storage 80. Said transportation unit 70 comprises a structure with a number of jutting supports 71 each able to hold a housing 2. In FIG. 3, the transportation unit is arranged to be transported by a motorised saddle 72, for instance to a place for maintenance. Preferably, the transportation unit 70 includes a raising and lowering device operated by a means for that purpose and arranged to lower the supports 71 to a level which facilitates the manual handling of the housings 2, and to raise the supports 71 to a level suitable for handling by one or more supports 31 of one or more handling units 30 mounted on the basic mobile unit 10.

In FIGS. 4 to 6 are shown a sequence of operations to transfer the housing 2 from the housing-bearing assembly 51 on the printing machine 50 to the support 31, in the form of a mandril on the handling unit 30. In FIG. 4, the support 31 has been aligned with the housing-bearing assembly 51 by operating the first and third means of operation on routes X, Z, and the support 31 has been brought up to and coupled with the housing-bearing assembly 51 by operating the transferral means as described above. In FIG. 5, the second means of displacement on route Y have moved the grasping/holding device 32 until it is coupled with the extremity of the housing 2 and in this position the grasping/holding device 32 is activated to take hold of the housing 2 by an activation means 34, 49 which will be described below. In FIG. 6, the second means of displacement are activated in the opposite direction to route Y in order to transfer the housing 2 held by the grasping/holding device 32 from the housing-bearing assembly 51 to the support 31. Next, the means of transferral can remove the support 31 from the housing-bearing assembly 51 to a prudent distance and the first and third activation means for routes X, Z can remove the basic mobile unit 10 and the handling unit 30 in order to transfer the housing 2 from the support 31 to a support 71, 81 on the transportation unit 70 or place of storage 80. To place a new housing 2 on the housing-bearing assembly 51 reverse operations are carried out.

Should the support 31 for example, be in the form of a cradle rather than a mandril the grasping/holding device may be taken from the above description or based upon the description in said patent application WO 03/095207.

Figure 7:
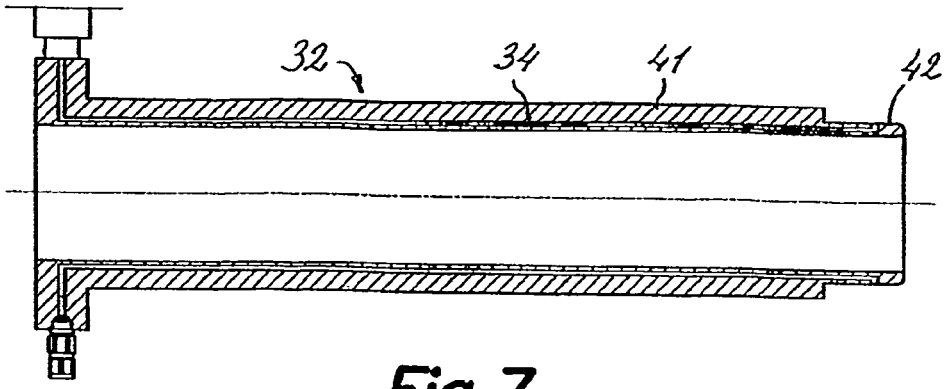
FIG. 7 is a detail cross-section view of the grasping/holding device according to the present invention arranged for grasping a housing.

In relation to FIG. 7 said grasping/holding device 32 is described below and comprises a tubular body 41 with a hollow interior into which is inserted a support 31 in the form of a mandril, such that said tubular body 41 can slide along the support 31, as shown in FIG. 4. The tubular body 41 has an external surface situated at an extremity 42 and arranged to couple with an inner surface at one extremity of the housing 2, said internal surface facing a lesser diameter on the housing-bearing assembly 51 (or support 71, 81 of the transportation unit 70 or place of storage 80). That is to say that the housing 2 is slightly longer than a cylindrical support portion on the respective assembly and said external surface of the extremity 42 of the tubular body 41 is sized to couple with the internal surface of the housing 2 which stands proud as shown in FIG. 5. Through said tubular body 41 are one or more bores 34, which open onto said external surface of extremity 42. Said means of activation of the grasping/holding device 32 comprise a first device for injecting air including a first valve (not shown) to selectively connect said bore 34 to a source of compressed air 49, which can include a compressor 49 mounted on the basic mobile unit 10. On the other hand, as is the convention with the state of the art, the printer incorporates a second air injection device including a second set of valves arranged to connect injection nozzles located in different positions on the housing-bearing assembly 51 to a source of compressed air. Activation of this second air injection device creates a cushion of air between the housing 2 and the housing-bearing assembly 51 which allows the sliding of the first along the second. According to the device of this invention the first air injection device alternatively works in cooperation with the second to grasp the housing 2 by the grasping/holding device 32 and slide the housing 2 onto the assembly 5.

Said cooperation is as follows. First of all, in the course of the operation to couple the external surface of the furthest extremity 42 of the tubular body 41 with the internal surface of an extremity of the housing 2, the said first valves are activated to inject compressed air along a bore 34 in order to slightly dilate the extremity of the housing 2 and facilitate the coupling whilst the second injection device remains inactive. Next, when the coupling has been completed the injection into the bore 34 is halted and the extremity of the housing 2 contracts, tightening over the external surface of the furthest extremity 42 of the tubular body 41. Then, the second injection device begins injecting compressed air between the housing 2 and the assembly 51 to create a cushion of air between the two whilst the second displacement means 35, 39, 40 act to transfer the housing 2, held by the grasping/holding device 32, from the assembly 51 to the support 31. For a transfer in reverse the same operations are carried out in reverse order.

In addition, should there be a need to ensure a firmer hold between the housing 2 and the furthest extremity 42 of the tubular body 41, when the coupling of the two is completed and the injection of air into the bore 34 ceased an intake is made along the same bore 34. For this, said first valves are activated to disconnect the bore 34 from the source of compressed air 49 and to connect it to a vacuum source which can be associated with the same compressor 49.

It should be pointed out that other configurations are possible for the grasping/holding device 32. For example, at the extremity of the grasping/holding device 32 claws may be placed which are activated pneumatically or by one or more electric motors to grip corresponding configurations at the extremity of the housing or a rapid coupling of the bearing type with a retractable hose similarly activated or a bayonet type device with rotary activation amongst others.

Preferably, in order to ease interaction between the support 30 and the grasping/holding device 32 of the handling unit 30, the support 71, 81 of the transportation unit 70 or of the place of storage 80 has the same characteristics as the housing-bearing assembly 51 on the printing machine including an injection device analogous to the second injection device described in relation to the housing-bearing assembly 51. As a consequence, the storage place 80 is equipped with a compressed air generator and a connection to a source of compressed air to supply the second injection devices fitted to the supports 81, and the second transferral area where the transportation unit 70 is stationed to interact with the handling unit 30 which is equipped with a flexible hose connected to a source of compressed air and fitted with a rapid connector able to be connected manually to an inlet port on the transportation unit 70 to supply the second injection devices fitted to the supports 71 on the same.

Throughout the specification and in the embodiment examples, the term 'housing' refers to housings bearing printblocks whether of the type mounted directly on the assembly or those mounted on intermediate housings, to said intermediate housings as well as anilox housings (inkers). In each case, the grasping/holding device 32 on the handling unit 30 will be adapted to the particular characteristics of each housing.

Figure 8:
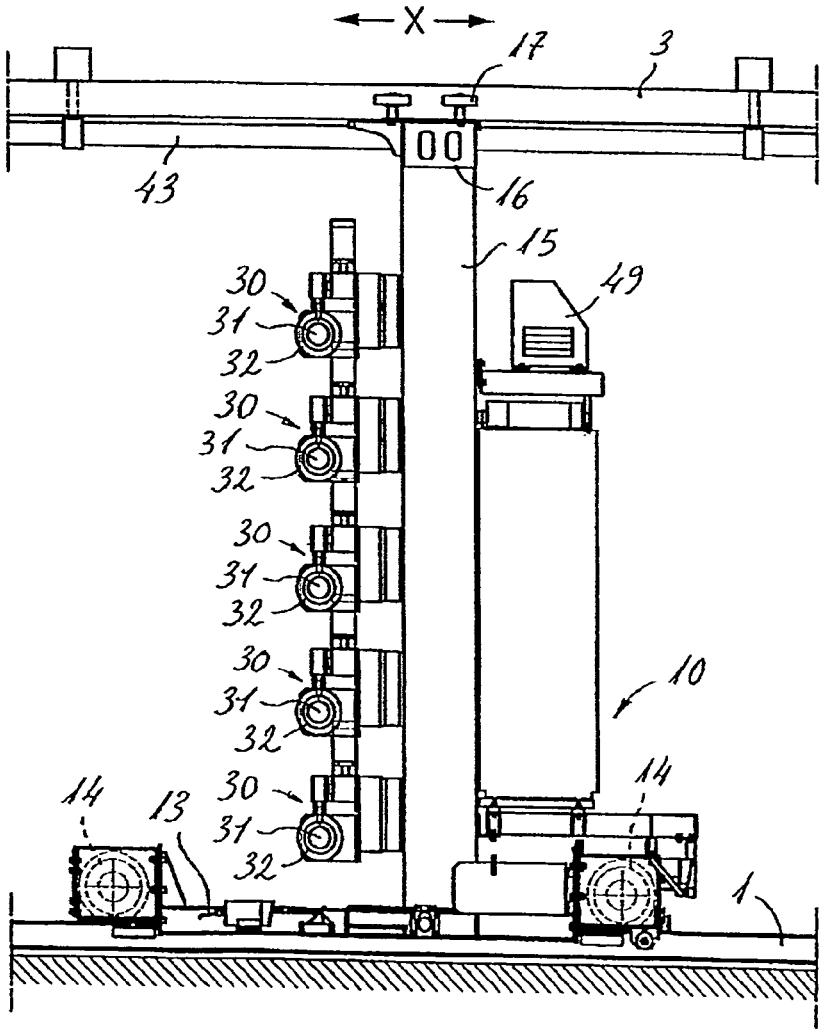
FIGS. 8 and 9 are frontal elevations of both variants of a second embodiment of the invention.
Figure 9:
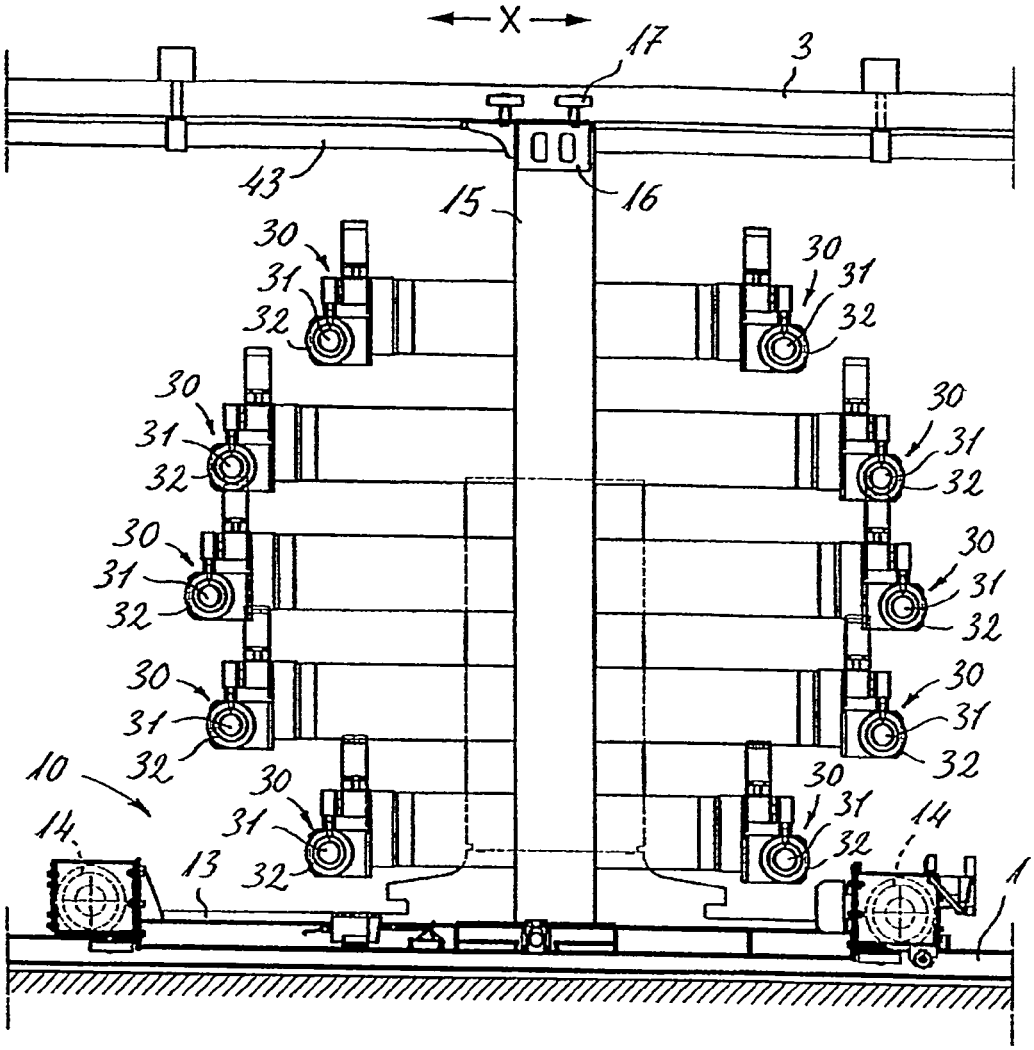

In FIGS. 8 and 9 are shown both variants of a second embodiment of the device of the invention characterised by having mounted on the basic mobile unit 10 various handling units 30 in fixed positions in place of the sole handling unit 30 associated with the third means of displacement 44, 45, 46 on the third route Z foreseen in the first embodiment described above. So, in this second embodiment said fixed positions in which the handling units 30 are placed are determined so that the respective supports 31 are found at a height which coincides with the height of various housing-bearing assemblies 51 on a printing machine 50 (and supports 71, 81 on the transportation unit 70 or place of storage 80). This arrangement allows the third means of displacement on route Z to be discarded with a saving of time in transferral operations at the expense of a lesser flexibility of the device.

In the variant shown in FIG. 8, the various supports 31 on the different handling units 30 are found at heights coinciding with the heights of all the housing-bearing assemblies 51 placed on one side of the support drum 52 on the printing machine 50. Preferably, the different handling units 30 on the basic mobile unit 10 are aligned vertically and at heights coinciding with those of all the housing-bearing assemblies 51 placed on each side of the support drum 52 on the printing machine 50. With this arrangement, the device is able to transfer one after the other all the housings 2 on the printing clusters on one side of the printing machine 50 with short displacements of the basic mobile unit 10 on route X. Advantageously, on the transportation unit 70 and/or the place of storage 80 the respective supports 71, 81 will be at heights which coincide with those of the supports 31 on the handling units 30 and similarly vertically aligned.

According to the second embodiment shown in FIG. 9, the fixed positions of the various handling units 30 mounted on the basic mobile units 10 are such that the respective supports 31 can be aligned at once with various housing-bearing assemblies 51 on the printing machine 50 and advantageously with all of the housing-bearing assemblies 51 on the printing machine 50, that is to say, whether with those arranged on one side as well as the other of the support drum 52. With this arrangement, once the basic mobile unit 10 is in position, all of the housings on the printing clusters on the printing machine 50 can be transferred simultaneously without any further displacement of basic mobile unit 10 on route X. As a result, the housing-bearing assemblies 71, 81 on the transportation unit 70 and/or the place of storage 80 can be arranged in identical positions relative to the housing-bearing assemblies 51 on the printing machine 50 in order to permit the simultaneous transfer of all the housings 2 between the handling units 30 and the transportation unit 70 and/or the place of storage 80.

Alternatively or in addition, and analogous to the description in relation to the first embodiment, the handling units 30 can be mounted on a gyratory structure linked to the basic mobile unit 10 by a means of rotation (not shown) arranged to rotate the gyratory structure with all the handling units 30 in relation to the basic mobile unit 10 around an axis parallel to the third route Z and at a certain angle to the second direction Y.

Figure 10:
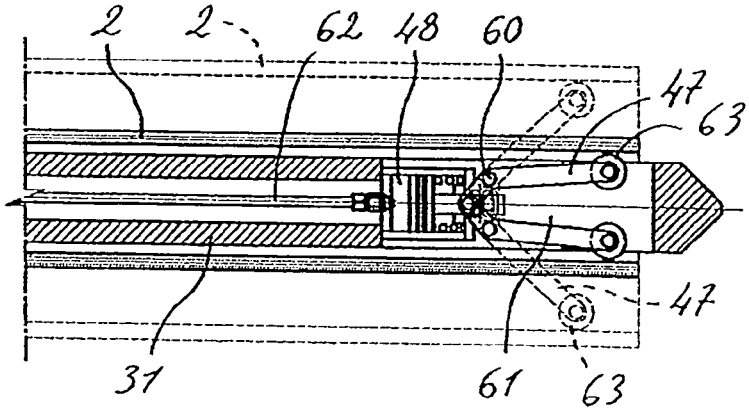
FIG. 10 is a detail cross-section view of a centring device associated with a mandril according to the present invention.

Finally, with reference to FIG. 10, a support 31 is designed to interact with various housings 2 with different internal diameters. Said support 31 is in the form of a jutting mandril with an external diameter equal or inferior to the smallest internal diameter of the various types of housing 2. In order to centre and coaxially align the housings 2 with the central axis of the support 31, this incorporates at least one radial centring device 47,48 which includes at least one pivoting arm 47 mounted in a cavity 61 on the mandril so that they can gyrate relative to the respective axes 60. An actuator 48, such as a fluo-dynamic cylinder is fitted and connected to activate the pivoting arms 47 in an extended position—the pivoting arms 47 project from the external surface of the support 31 pressing against the internal surface of the housing 2, and in folded position in which the pivoting arms 47 are hidden inside said cavity 61. Preferably, each of the pivoting arms 47 has a wheel 63 mounted at its furthest extremity. Said fluo-dynamic cylinder 48 is housed in the cavity 61 and supplied through a bore 62 through the hollow interior of the mandril.

The device of the present invention comprises also, a positioning device on the first route X (not shown) which is made up of at least one detector chosen from a group which includes a telemeter, a codifier and an optical gauge connected to other electronic processing means arranged to control the operation of said first means of displacement 11, 14. Said detector gives a rough position by which said positioning device on the first route X which also includes at least one photo-electric sensor connected to said electronic processing means in order to refine the rough positioning given by said detector. Analogously, the device of the invention comprises a positioning device on the third route Z (not shown) which is made up of a detector chosen from a group which includes a telemeter, a codifier or an optic gauge connected to electronic processing means arranged to control the operation of said third means of displacement 44, 45, 46, and at least one photo-electric sensor connected to said electronic processing means in order to refine the rough positioning given by said detector.

The specific embodiments described above are merely illustrative and by no means limit the scope of the present invention which is defined in the attached claims.

The invention claimed is:

1. An automatic handling and transportation device for printer housings comprising: a support, for support of the housings able to be positioned in alignment with a housing-bearing assembly and in proximity with it, and a grasping/holding device adapted to be displaced between i) a transferal position in which said grasping/holding device interacts with said housing installed on said housing-bearing assembly to grasp or free it and ii) a transportation position in which the housing held by the grasping/holding device is on the support;

a basic mobile unit associated with a first means of displacement arranged to displace said basic mobile unit on a first route; and at least one handling unit mounted on said basic mobile unit, said handling unit including said support, which is held in a jutting position on a second route, transverse to said first route and parallel to said housing-bearing assembly mounted in a jutting position on a printing machine, and a second means of displacement arranged to displace said grasping/holding device on said second route in relation to the support, wherein the basic mobile unit moves along guide means which extend on said first horizontal route along a stretch which includes a first transfer area in which said handling unit mounted on the basic mobile unit operates to exchange housings with said printing machine, and at least a second transfer area in which the support on the handling unit mounted on the basic mobile unit is able to be positioned in alignment with a housing support installed on a transportation unit or in a place of storage, said handling unit operating to exchange housings with said transportation unit or with said place; wherein a single handling unit is mounted on the basic mobile unit, and fitted with third means of displacement to move the handling unit in relation to the basic mobile unit on a third, vertical route, transverse to the first and second routes.

2. The device, according to claim 1, wherein several handling units are mounted on the basic mobile unit in fixed positions in which the respective supports are at a height coinciding with the height of several housing-bearing assemblies on the printing machine, or supports on the transportation unit, or the place of storage.

3. The device, according to claim 2, wherein several housing-bearing assemblies on the printing machine comprise all of the housing-bearing assemblies arranged on one side of the support drum of the printing machine.

4. The device, according to claim 3, wherein said fixed positions on several handling units on the basic mobile unit are vertically aligned.

5. The device, according to claim 2, wherein said fixed positions of the various handling units on the basic mobile unit are such that the respective supports can be aligned at once with various housing-bearing assemblies on the printing machine or supports on the transportation unit, or the place of storage.

6. The device, according to claim 5, wherein various housing-bearing assemblies on the printing machine comprise all of the housing-bearing assemblies on both sides of a support drum on the printing machine.

7. The device, according to claim 6, wherein the supports on the transportation unit and/or the place of storage are in identical positions relative to the housing-bearing assemblies on the printing machine.

8. The device, according to claim 2, wherein said transportation unit comprises a raising and lowering device activated by a means of activation and arranged to lower the supports to heights suitable for handling the housings, and for raising the supports to said heights coinciding with the height of the supports of the various handling units mounted on the basic mobile unit in fixed positions.

9. The device according to claim 1, wherein the basic mobile unit comprises a lower section fitted with wheels in contact with at least one way which forms part of said guide-means on the first route at least one of said wheels being a tractor wheel activated by a motor and an elevated section which supports the handling unit.

10. The device, according to claim 9, wherein a basic mobile unit also comprises an upper section fitted with wheels in contact with at least one upper way which forms part of the guide means on the first route.

11. The device, according to claim 10, wherein said upper way has associated with it, along the length of the same, at least one electrical supply conducting track and/or control signals and said upper section of the basic mobile unit including a dynamic electrical current input device to supply said electrical current and/or signals from said track.

12. The device, according to claim 11, wherein said positioning device on the first route also includes at least one photoelectric sensor connected to said electronic processing means for control of the activation of said first means of displacement in order to refine the positioning carried out by said detector.

13. The device, according to claim 1, wherein said second means of displacement comprises guide means on the second route, adjacent to the support, with which is associated a saddle to which is connected the grasping/holding device, and a motor connected and arranged to move said saddle along said guide means.

14. The device, according to claim 13, further comprising means of transference arranged to transfer said support on said second route in order to bring the furthest extremity of the support close to the furthest extremity of the housing-bearing assembly or support when the support is in alignment with the same.

15. The device, according to claim 14, wherein said means of transfer comprises guide means on the second route, with which is associated a saddle to which is fixed an extremity of the support, and a motor connected and arranged to move said saddle along said guide means.

16. The device, according to claim 15, wherein said guide means, along which said saddle moves, bears the grasping/holding device fixed to said saddle, bearing the support and moving along the same.

17. The device, according to claim 1, wherein said grasping/holding device comprises a tubular body mounted to slide along the support and provided with an external surface at one extremity arranged to couple with the internal surface of an extremity of the housing facing a section of the smaller diameter of the housing-bearing assembly or support, and at least one bore through said tubular body, open at said external surface.

18. The device, according to claim 17, wherein said means of activation of the grasping/holding device comprises first valves arranged to connect said bore to a source of compressed air, with which it facilitates a slight dilation of the extremity of the housing for said coupling and then disconnecting the bore from said source of compressed air, facilitating recovery of the form of the extremity of the housing and a tightening of the furthest extremity of the tubular body.

19. The device, according to claim 18, wherein said valves are also arranged to connect said bore to a vacuum source once disconnected from the source of compressed air.

20. The device, according to claim 18, wherein the first valves connect alternatively with second valves arranged to connect injection nozzles incorporated into the housing-bearing assembly or support to a source of compressed air in order to create an air cushion between the housing and the housing-bearing assembly or support with which to facilitate a sliding movement between the two.

21. The device, according to claim 17, wherein the first valves connect alternatively with second valves arranged to connect injection nozzles incorporated into the housing-bearing assembly or support to a source of compressed air in order to create an air cushion between the housing and the housing-bearing assembly or support with which to facilitate a sliding movement between the two.

22. The device, according to claim 1, wherein said third means of displacement comprises guide means, arranged on the third route along an elevated section of the basic mobile unit, with which is associated a saddle on which is mounted a handling unit, and a motor connected and arranged to move said saddle along said guide means.

23. The device, according to claim 1, wherein the support has the form of a mandril in a jutting position and incorporates at least one radial centering device to align the housings coaxially with the support.

24. The device, according to claim 23, wherein said radial centering device includes at least two pivoting arms, each with a wheel mounted at its furthest point activated by an actuator to project from the external surface of the support or to be hidden inside the same.

25. The device, according to claim 1, further comprising a positioning device on the first route comprising at least one detector selected from the group consisting of a telemeter, a codifier and an optical gauge, connected to an electronic processing means adapted to control the activation of said first means of displacement.

26. The device, according to claim 1, further comprising a positioning device in third route made up of a detector selected from the group consisting of a telemeter, a codifier or an optical gauge connected to an electronic positioning means adapted to control the activation of said third means of displacement.

27. The device, according to claim 26, wherein said positioning device on the first route also includes at least one photoelectric sensor connected to said electronic positioning means for controlling the activation of the third means of displacement in order to refine the positioning carried out by said detector.

28. The device, according to claim 1, wherein said handling unit is mounted on said basic mobile unit by means of a means of rotation arranged to rotate the handling unit in relation to the basic mobile unit around an axis parallel to the third vertical route, transverse to the first and second routes, and at a predetermined angle with respect to the second route.

29. The device, according to claim 1 wherein said support has the form of a mandril in a jutting position with the furthest extremity able to be facing, with or without contact, said housing-bearing assembly.

30. The device, according to claim 1, wherein said support has the form of a cradle with an extremity able to be situated in alignment with said housing-bearing assembly.

* * * * *